US012571138B2

(12) United States Patent
Schoppel et al.

(10) Patent No.: US 12,571,138 B2
(45) Date of Patent: Mar. 10, 2026

(54) KNITTED COMPONENT INCLUDING KNIT OPENINGS FORMED WITH RELEASABLE YARN

(71) Applicant: Nike, Inc., Beaverton, OR (US)

(72) Inventors: Andreas I. Schoppel, Beaverton, OR (US); Shannon J. Basa, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 702 days.

(21) Appl. No.: 17/950,710

(22) Filed: Sep. 22, 2022

(65) Prior Publication Data

US 2023/0020388 A1 Jan. 19, 2023

Related U.S. Application Data

(62) Division of application No. 16/750,133, filed on Jan. 23, 2020, now Pat. No. 11,453,964.

(60) Provisional application No. 62/796,195, filed on Jan. 24, 2019.

(51) Int. Cl.

| | |
|---|---|
| ***D04B 1/16*** | (2006.01) |
| ***D04B 1/00*** | (2006.01) |
| ***D04B 1/10*** | (2006.01) |
| ***D04B 1/12*** | (2006.01) |
| ***D06C 23/02*** | (2006.01) |

(52) U.S. Cl.

CPC ..... *D04B 1/16* (2013.01); *D04B 1/00* (2013.01); *D04B 1/104* (2013.01); *D04B 1/12* (2013.01); *D06C 23/02* (2013.01); *Y10T 442/40* (2015.04)

(58) Field of Classification Search

None

See application file for complete search history.

(56) References Cited

U.S. PATENT DOCUMENTS

| | | | |
|---|---|---|---|
| 6,871,515 | B1 | 3/2005 | Starbuck et al. |
| 2002/0083820 | A1 | 7/2002 | Greenhalgh |
| 2016/0353810 | A1 | 12/2016 | Barnes et al. |
| 2017/0073861 | A1 | 3/2017 | Herold-herrmann et al. |
| 2017/0145604 | A1 | 5/2017 | Dua et al. |

(Continued)

FOREIGN PATENT DOCUMENTS

| | | | | |
|---|---|---|---|---|
| AT | 508899 | A4 | 5/2011 | |
| AT | 508899 | B1 * | 5/2011 | ..... D04B 1/12 |
| CN | 104363782 | A | 2/2015 | |

(Continued)

OTHER PUBLICATIONS

English Translation AT508899 (Year: 2011).*

(Continued)

*Primary Examiner* — Jenna L Johnson

(74) *Attorney, Agent, or Firm* — Shook, Hardy & Bacon L.L.P.

(57) ABSTRACT

A knitted component includes a first yarn and a second yarn, where the first yarn comprises a thermoplastic material having a melting temperature. The first yarn is used to create window openings of different shapes and sizes within the knitted component. This is achieved by using the first yarn to releasably secure adjacent edges of a window opening. The first yarn is then heated to release, at least in part, the first yarn from the edges of the window opening, allowing the edges to separate and thereby form a window opening.

19 Claims, 8 Drawing Sheets

(56) References Cited

U.S. PATENT DOCUMENTS

2020/0240054 A1 7/2020 Schoppel et al.

FOREIGN PATENT DOCUMENTS

| | | | |
|---|---|---|---|
| CN | 108699738 | A | 10/2018 |
| EP | 3338585 | A1 | 6/2018 |
| WO | 01/83865 | A1 | 11/2001 |
| WO | 2005/092199 | A1 | 10/2005 |
| WO | 2015/100369 | A1 | 7/2015 |
| WO | 2018/089639 | A1 | 5/2018 |

OTHER PUBLICATIONS

Intention to Grant received for European Patent Application No. 20704980.0, mailed on Aug. 1, 2023, 7 pages.
Intention to Grant received for European Application No. 22153908.3, mailed on Jan. 9, 2024, 7 pages.

* cited by examiner

600

KNITTED COMPONENT INCLUDING KNIT OPENINGS FORMED WITH RELEASABLE YARN

RELATED APPLICATIONS

This non-provisional application is a divisional application of co-pending U.S. patent application Ser. No. 16/750,133, filed Jan. 23, 2020, and titled "Knitted Component Including Knit Openings Formed with Releasable Yarn," which claims priority to U.S. Provisional Application No. 62/796,195, filed Jan. 24, 2019, and titled "Knitted Component Including Knit Openings Formed with Releasable Yarn," which are both incorporated herein by reference in their entirety.

BACKGROUND

There is a wide range of materials that may be used to knit a knitted component. This availability of materials to select from allows for the creation of knitted components having a wide range of properties and applications. Such properties may include weatherproofing, rigidness, opaqueness, or other measurable properties. Having these properties, knitted components can be used for a range of applications, including but not limited to the creation and manufacture of apparel, athletic equipment, footwear, upholstery for furniture, as well as other applications.

Even with the availability of different materials and uses for knitted components, there have been some limitations for creating certain structures in a knitted component. This includes, for example, apertures and/or openings in a knitted component to achieve a particular structure or aesthetic appearance. Known knitting technology typically allows for knitting an opening, hole or aperture directly into the textile. However, such a direct knitting technique may limit the size, configuration and/or shapes available for such openings, resulting in limited structural and/or design choices. These known knitting techniques can also be inefficient as it may require the knitting process to start and stop at various points to achieve the knitted openings. For example, an intarsia hold knitting technique requires starting and stopping a yarn feeder to create the direct knit opening into a knitted textile. As such, it is advantageous to utilize particular knitting techniques as described herein, using particular yarns and materials, to more efficiently create a knit textile having one or more holes, openings and/or apertures, thereby achieving desirable structural and/or aesthetic properties.

DETAILED DESCRIPTION

Figure 1:
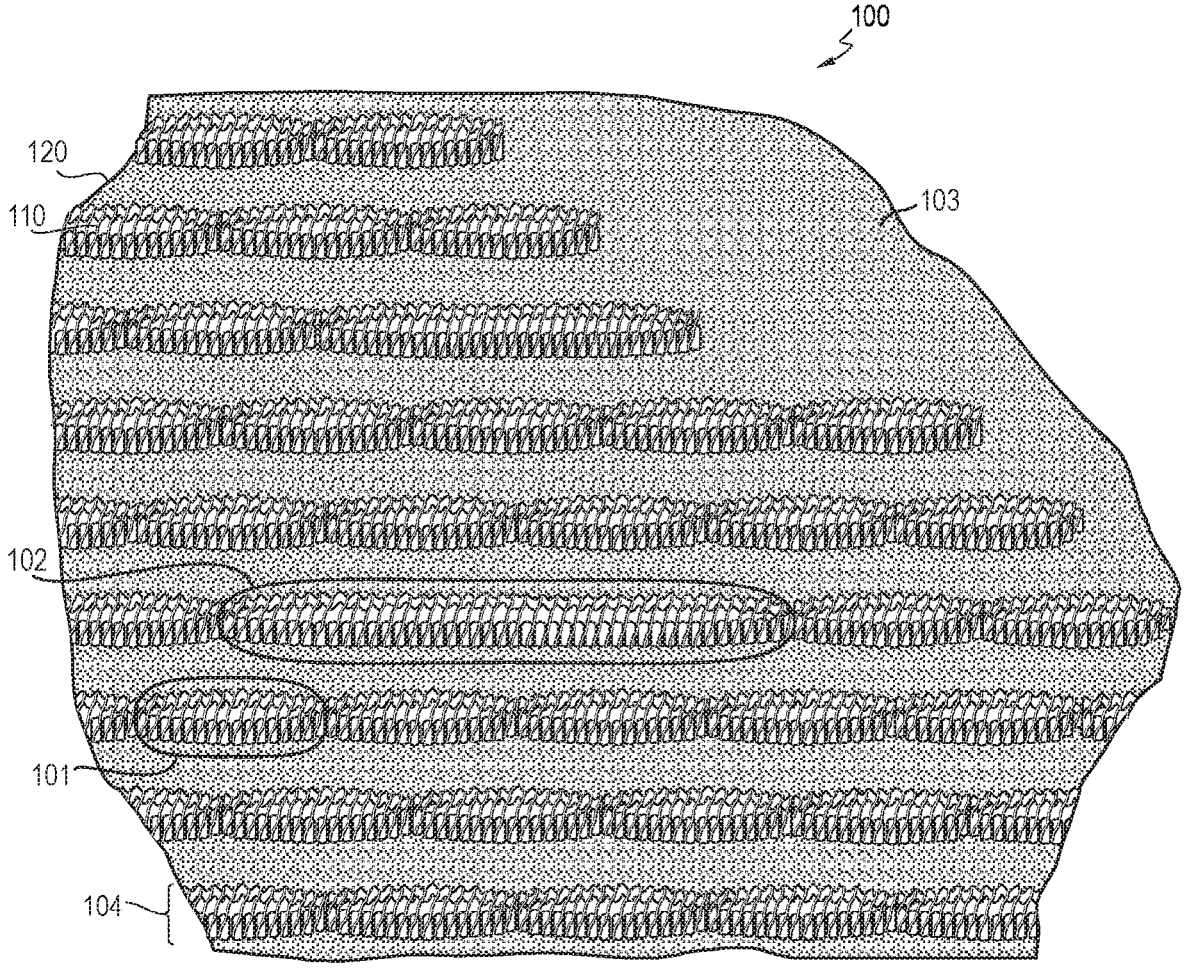
FIG. 1 shows an exemplary knitted component prior to a heating process in accordance with certain embodiments of this disclosure.

Various aspects are described below with reference to the drawings in which like elements generally are identified by like numerals. The relationship and functioning of the various elements may better be understood by reference to the following description. However, aspects are not limited to those illustrated in the drawings or explicitly described below. It also should be understood that the drawings are not necessarily to scale, and in certain instances, details may have been omitted that are not necessary for an understanding of aspects disclosed herein.

Certain aspects of the present disclosure relate to uppers configured for use in an article of footwear and/or other articles, such as articles of apparel. When referring to articles of footwear, the disclosure may describe basketball shoes, running shoes, biking shoes, cross-training shoes, football shoes, golf shoes, hiking shoes and boots, ski and snowboarding boots, soccer shoes, tennis shoes, and/or walking shoes, as well as footwear styles generally considered non-athletic, including but not limited to dress shoes, loafers, and sandals.

According to an embodiment, a knitted component is disclosed comprising a first yarn comprising a thermoplastic material having a first melting temperature that is greater than 55 degrees Celsius, and a second yarn having a second melting temperature that is greater than 170 degrees Celsius. The knitted component may further comprise a window region comprising the first yarn, a curling region adjacent to a first edge of the window region, wherein the curling region includes both the first yarn and the second yarn knit together in a single jersey knit structure, and a transition region adjacent to a second edge of the window region, wherein the transition region comprises the second yarn.

According to an embodiment, a textile is disclosed comprising a window opening having a first edge and a second edge that are separated to define the window opening therebetween. A curling region is adjacent to the first edge, wherein the curling region comprises a first yarn comprising a thermoplastic material and a second yarn. The second yarn is knit in a single jersey knit structure. The first yarn in the curling region is at least partially fused to the second yarn. A transition region is adjacent to the second edge, wherein the transition region comprises the second yarn.

According to an embodiment, a method of forming a textile is disclosed. The method comprises knitting a first region with a second yarn on a first needle bed, transferring the second yarn on the first needle bed to a second needle bed, knitting, into a single jersey knit structure, a curling region with both a first yarn and the second yarn on the second needle bed, knitting a window region with the first yarn, wherein the first yarn comprises a thermoplastic material having a first melting temperature, and heating the textile to at least the first melting temperature to at least partially melt the first yarn.

Accordingly, it may be advantageous to strategically place a releasable yarn into regions of the knitted component where openings are desired. In other parts of the knitted component where openings are not desired, a non-releasable yarn may be used. In this context, the releasable yarn may comprise a fusible yarn made, at least in part, from a thermoplastic material. In one example, the fusible yarn may have a melting temperature that is lower than a melting temperature of the non-releasable yarn. It is also contemplated that a releasable yarn may comprise a yarn that melts, dissolves, shrinks, degrades, disintegrates or otherwise chances physical properties such that, in response to a process, exposure, treatment and/or stimulus, an opening can be formed where the releasable yarn was once present.

A heating process may be applied to the knitted component at a temperature that exceeds a melting temperature of a releasable yarn, while keeping the temperature below a melting temperature of a non-releasable yarn. This heating process acts to release (e.g., melt, dissolve, shrink, degrade, disintegrate or other process for removing) the releasable yarn away from the non-releasable yarn to create desired window openings where the releasable yarn is removed, while maintaining the integrity of the knitted component in the rest of the knitted component. In some areas, such as around a perimeter edge of the openings, the releasable yarn may fuse or melt on, upon and/or over and secure any raw edges of the non-releasable yarn that may otherwise be left exposed after the releasable yarn is detached from at least a portion of the respective edges of the opening, such as by exposure to a heating process. By utilizing the releasable yarn in this way, a knitted component may be created that has openings of varying sizes and shapes placed in desired locations, resulting in a desirable structure and/or aesthetic design.

In FIG. 1, an exemplary portion of a knitted component 100 is shown prior to a heating process being applied. The knitted component 100 is comprised of at least two types of yarn: a first yarn 110 comprising a thermoplastic material, and a second yarn 120 comprising a polyester material. For purposes of this disclosure, the first yarn 110 is a fusible yarn and may be understood to be a "releasable yarn," while the second yarn 120 may be understood to be a "non-releasable yarn." While various different combinations of yarn materials may be used for the first yarn 110 and the second yarn 120, according to the disclosed embodiments, the first yarn 110 is a fusible yarn having a melting temperature that is lower than a melting temperature of the second yarn 120. The second yarn 120 may be any yarn having a melting temperature (or a decomposition temperature, if the second yarn does not have a melting temperature) that is greater than the melting temperature of the first yarn 110. The relatively higher melting temperature of the second yarn 120, when compared to the melting temperature of the first yarn 110, allows for applying a heating process to the knitted component 100 having a pre-determined temperature that will at least partially melt the first yarn 110 without melting (or decomposing) the second yarn 120.

The knitted component 100 as shown in FIG. 1 includes a first window region 101 and a second window region 102, where each window region is configured to form a window opening and a surrounding region that forms at least a portion of the perimeter and shape of the window opening. The first window region 101 and the second window region 102 are shown to be of differing sizes, with window region 102 including a larger opening (with size being measured by a longitudinal diameter, number of courses, number of wales and/or number of stitches, for example) than the size of a window opening of the first window region 101. According to some embodiments, a window opening created through the process described herein may be as large one that extends through all, or substantially all, of the full pattern width of the knitted component 100. According to some embodiments, a window opening created through the process described herein may be controlled so as to not exceed a predetermined width as measured by a particular number of needles, a particular number of courses or wales, a particular number of stitches or knit loops, or a particular measured dimension (e.g., 24 needles, 3 inches, one or more courses or wales), or range of widths (e.g., 3-4 inches, 10-25 needles, etc.), to maintain an acceptable level of structural integrity of the knitted component 100 and/or for aesthetic reasons (e.g., to prevent larger window openings to avoid viewing into the inside of an article of apparel or footwear incorporating the knitted component 100). However, even if the width of one or more of the window openings were created so as to exceed a particular size, any potential loss of structural integrity could be maintained by compensating for a larger open by bonding a backing to the knit component as a reinforcement or providing another reinforcing layer or structure, for example.

As FIG. 1 depicts the knitted component 100 prior to a heating process, respective edges of the first window region 101 and the second window region 102 (i.e., that will later define the boundaries of the above-mentioned window opening) are shown to still be connected through knit structures formed by the first yarn 110. These edges of the window regions included in the knitted component 100 may separate, thus forming window openings in the first and second window regions 101 and 102 following a heating process, as described in more detail herein.

Other portions of the knitted component 100, such as a design region 103, may be comprised of the second yarn 120 (in addition to, and/or as an alternative to, the first yarn 110 and/or other yarns). For example, the design region 103 may be comprised of various combinations of the second yarn 120 (which may represent one or more types of yarn other than the thermoplastic first yarn 110) that have the same properties and/or characteristics, different properties and/or characteristics, or combinations of characteristics such as color, density, thickness, or other measurable and/or visual yarn characteristics to provide the design region 103 with particular mechanical properties and/or visual effects. Still other portions of the knitted component 100, such as a curling region 104 (not yet shown in a curled state in FIG. 1), may be comprised of one of more of the first yarn 110 and the second yarn 120.

Illustrative, non-limiting examples of thermoplastic materials that may comprise the first yarn 110 include polyurethanes, polyamides, polyolefins, nylons, and resins. In contrast to thermoset polymeric materials, thermoplastic polymers at least partially melt when heated to a certain temperature and return to a solid state when cooled below a certain temperature. More particularly, a thermoplastic polymer transitions from a solid state to a softened or liquid state when subjected to temperatures at or above its melting point, and then the thermoplastic polymer transitions from the softened or liquid state to a solid state when sufficiently cooled below its melting point. Furthermore, when heated to a certain temperature (approaching the melting temperature and beyond), a yarn made from thermoplastic material may significantly dissolve or shrink in physical size to create a void where the yarn previously existed. As such, thermoplastic materials may be melted, molded, cooled, hardened, dissolved, and/or caused to shrink through various heating and/or cooling cycles.

Any portion of the first yarn 110 may have one or more thermoplastic polymers or other materials (collectively "the thermoplastic material"), and in some embodiments, substantially the entirety of the first yarn 110 may be formed of the thermoplastic material. In one non-limiting example, the first yarn 110 may be a fusible yarn comprised of a polyester substrate with poly block amide resin, have a linear mass density of about 150 denier, a tenacity of about 2.5 cN/dtex, an elongation percentage of about 80%, a twist per meter (TPM) of around 300 Z, and a melting temperature within the range of 55-65° C. based on atmospheric pressure at sea level. The first yarn 110 may be referred to herein as "Grilon® KE60," available commercially by EMS-Chemie AG of Switzerland and/or as identified internally by the Applicant.

As described, the knitted component 100 also includes at least one or more yarns formed of material(s) other than the specific thermoplastic material described above for the first yarn 110. For example, portions of the knitted component 100 are formed using the second yarn 120. To achieve the higher melting temperature (and/or higher decomposition temperature) compared to the melting temperature of the first yarn, the second yarn 120 is formed from a different material composition from the first yarn 110. In one example, the second yarn 120 may be substantially formed of a material that has a melting point (if it is a thermoplastic material) or a decomposition temperature (if it is a thermoset material) that is higher than the melting point (or decomposition temperature) of the first yarn 110. Illustrative, non-limiting examples of types of yarns that may form the second yarn 120 include yarns comprising thermoplastic materials, or, alternatively, thermoset polymeric materials and natural fibers, such as cotton, silk, and wool, or materials with a relatively high melting or decomposition point. In some embodiments, the melting point or decomposition temperature of the second yarn 120 is greater than about 170° C. based on atmospheric pressure at sea level.

In one non-limiting example, the second yarn 120 may comprise one or more yarns having different yarn properties relating to elasticity, breathability, denier, color, and/or durability characteristics or different visual characteristics, or a combination thereof, for example. According to some embodiments, the second yarn 120 is a polyester based yarn, comprised primarily, if not all, of polyester strands. In some embodiments, the second yarn may be comprised primarily of one or more strands of polyester material over a core material, thus providing stretch and recovery properties, as well as compression, among other desirable properties, for example. In one non-limiting example, the core material of the second yarn 120 may be an elastane material, such as Lycra, which is wrapped with a recycled polyester material (e.g. two strands of polyester yarn, each having about 150 Denier), which provides the second yarn 120 with an elasticity property (e.g., 89% polyester to 11% Lycra). According to this non-limiting example, the second yarn 120 may have a first melting temperature e.g., above about 170° C.) at which the core Lycra may begin to melt, and have a second melting temperature (e.g., range between about 200-250° C.) at which the polyester material wrapping the Lycra core begins to melt. The second yarn 120 may be referred to herein as "E04," as referred to commercially and/or as identified internally by the Applicant.

Figure 2A:
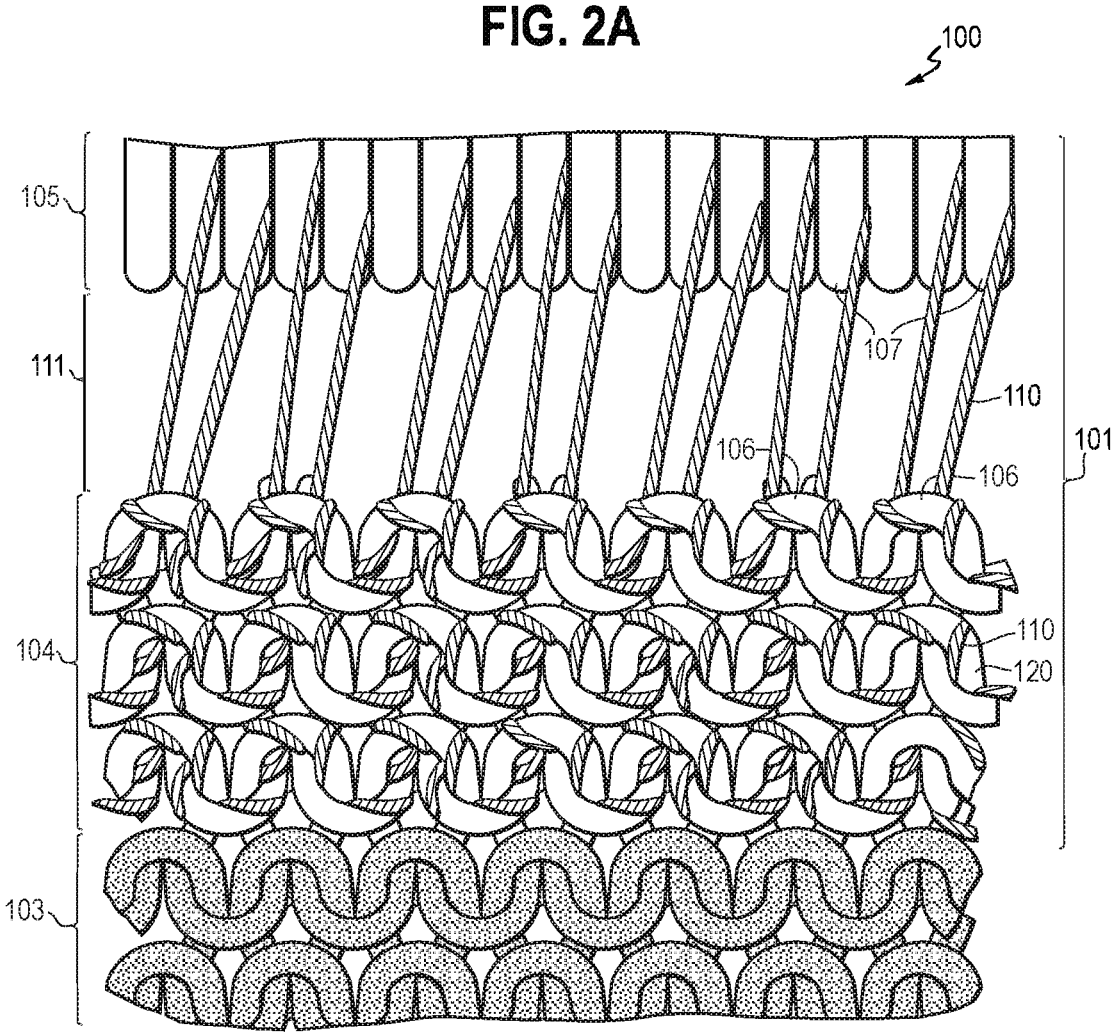
FIG. 2A shows a magnified view of an exemplary knitted component prior to a heating process in accordance with certain embodiments of this disclosure.

FIG. 2A shows a magnified view of an exemplary window region found in the knitted component 100 prior to a heating process being applied to melt the first yarn 110 included in a window region. For example, the window region depicted in FIG. 2A may correspond to the first window region 101. The first window region 101 includes a portion that is configured to later become a window opening 111, but, prior to a heating process, the one or more edges that will later separate to form the opening (e.g., defined by an upper edge region 105 and lower edge region 104) are connected exclusively with the first yarn 110 (as shown). Thus, the first window region 101 is also comprised of a surrounding region that includes an upper edge defined by the upper edge region 105, and a lower edge defined by the lower edge region 104 (also referred to as the curling region 104). The upper edge region 105 may optionally be comprised exclusively of the second yarn 120, but the first yarn 110 may also be included in the upper edge region 105 in other embodiments. One or more other yarns may be included in the upper edge region 105 according to other embodiments. The second yarn 120 included in the upper edge region 105 may be knit using a knit structure that generally does not have a curling tendency characteristic, such as a double jersey knit structure.

The curling region 104, which defines at least a portion of the lower edge of the window opening 111, may be comprised of a knit structure formed from a combination of the first yarn 110 and the second yarn 120. For example, the curling region 104 may be comprised of a plated yarn structure that combines both the first yarn 110 and the second yarn 120. The ends of the knit loops 106 in the curling region 104 (e.g., defining a lower edge of the window opening 111) are connected to one or more of the knit loops 107 that form the upper edge region 105 via the first yarn 110 prior to a heating process. In other examples, the curling region 104 (and/or other regions adjacent to the eventual window opening) may include a yarn having a different melting point (e.g., via a different material composition) than the yarn connecting the knit loops 107 and the knit loops 106, but in the present embodiment, the same first yarn 110 is used in both regions. According to some embodiments, the curling region 104 may occupy both the upper edge region 105, as well as the lower edge region 104 of the window opening. According to some embodiments, the curling direction may be in either direction (e.g., generally inwards or outwards) for each of the curling regions that are included in the knitted component 100 thus aiding in forming the window openings.

Figure 2B:
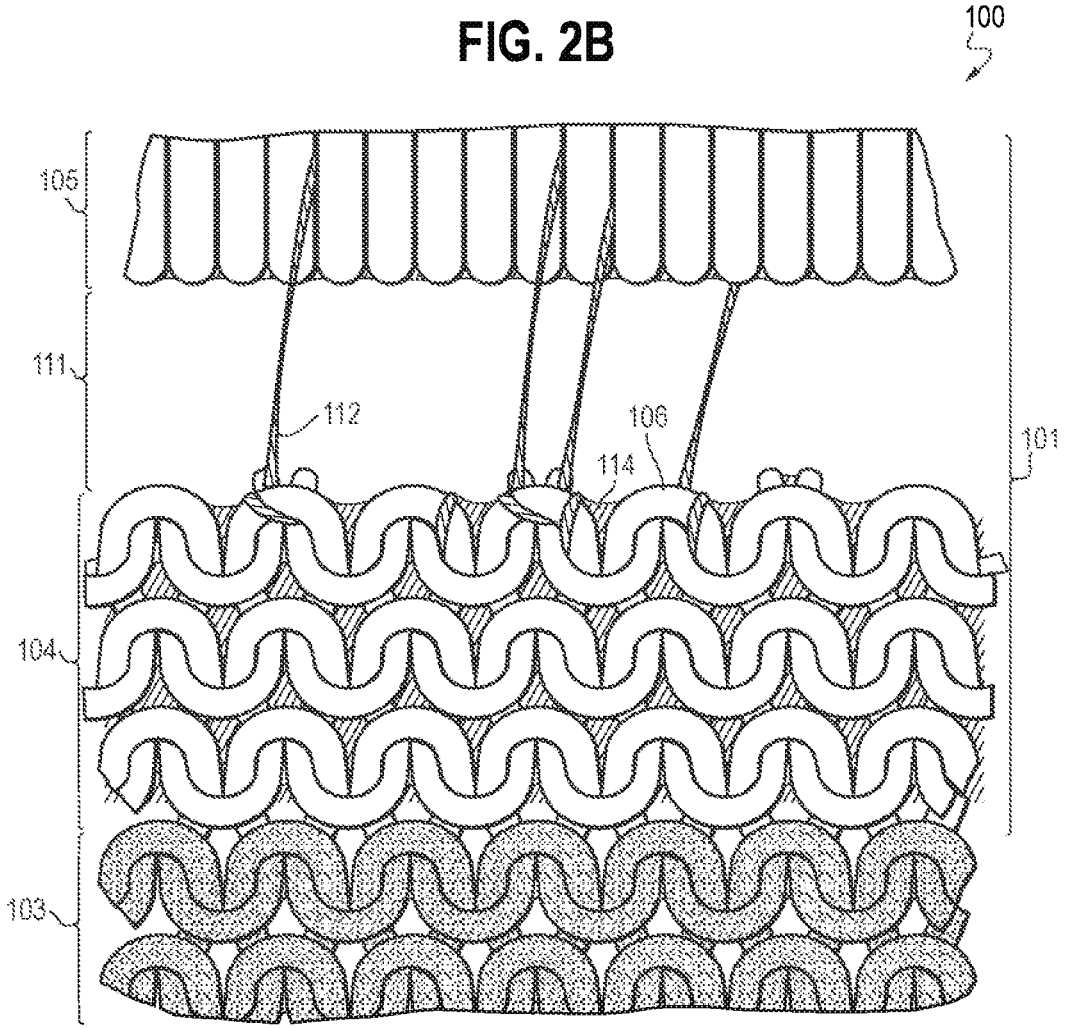
FIG. 2B shows a magnified view of the exemplary knitted component shown in FIG. 2B after a heating process in accordance with certain embodiments of this disclosure.

FIG. 2B shows a magnified view of the first window region 101 after a heating process is applied. The heating process may be a steaming process for heating one or more of the window regions of the knitted component 100 to a temperature that exceeds the melting temperature of the first yarn 110, while staying below the melting temperature (and/or decomposition temperature) of the second yarn 120. By heating the first window region 101 as such, the first yarn 110 that connects the respective edges of the window opening 111 is substantially, if not completely, melted and/or dissolved, thereby detaching the upper edge region 105 from the lower edge region 104. For any amount of melted portions 112 of the first yarn 110 that is not removed by the heating process, such melted portions 112 may re-harden into a more weakened physical structure following a cooling process, and be broken away from the window opening 111 with physical agitation applied to the window opening 111 (e.g., stretching the knitted component 100 to pull open the window opening 111), though such physical agitation is optional.

Figure 3:
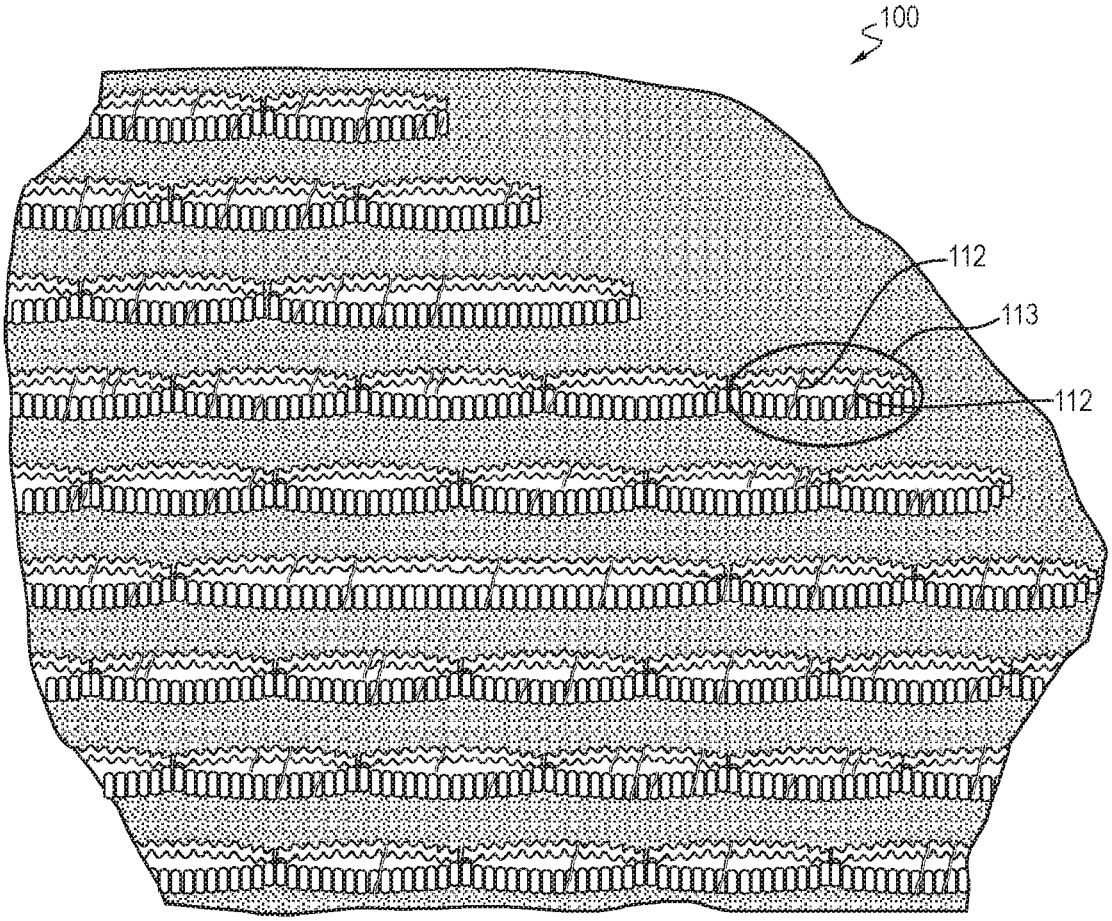
FIG. 3 shows the exemplary knitted component shown in FIG. 1 after a heating process in accordance with certain embodiments of this disclosure.
Figure 4:
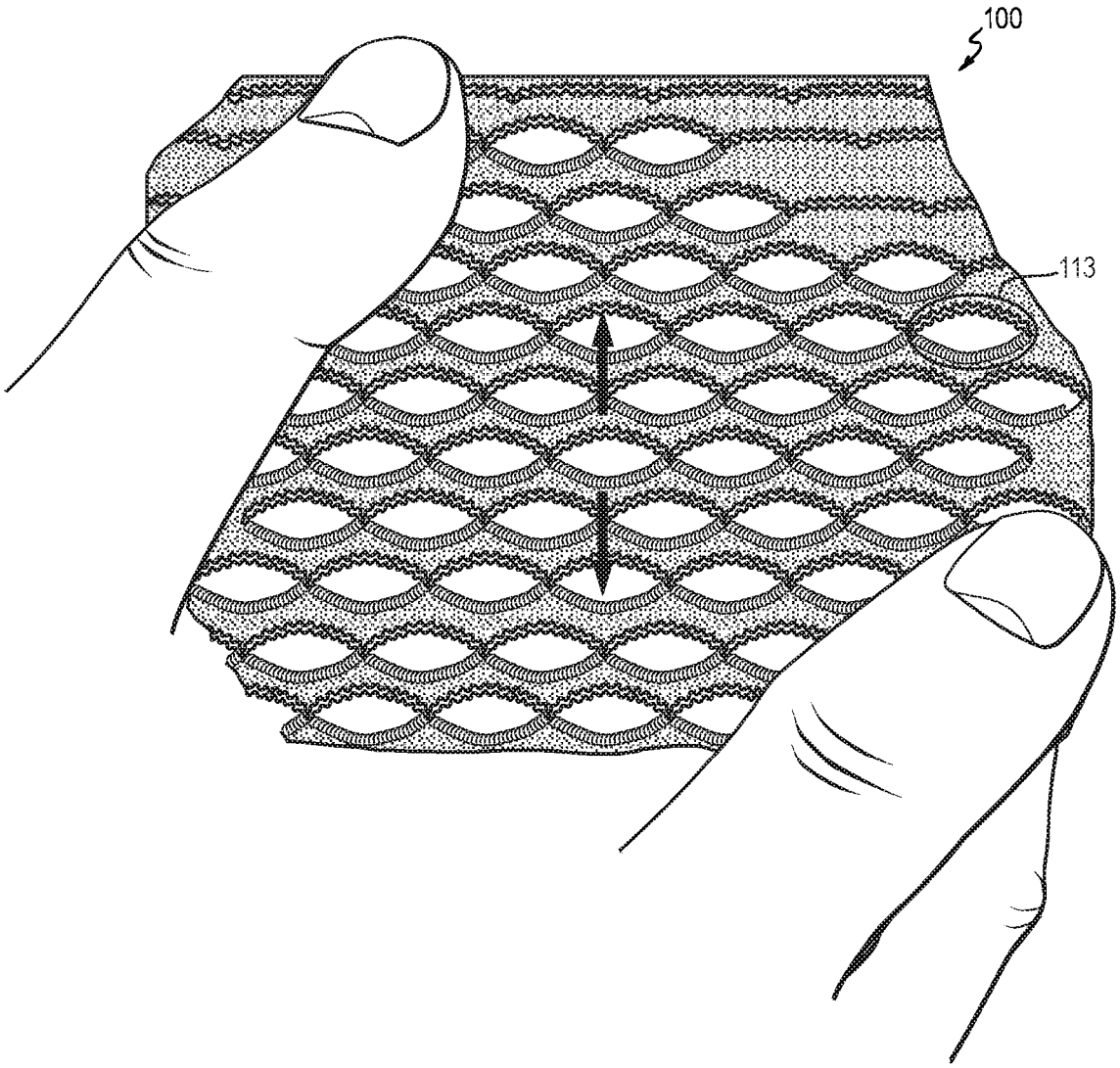
FIG. 4 shows the exemplary knitted component shown in FIG. 1 after a heating process and having an external force applied in accordance with certain embodiments of this disclosure.

For example, FIG. 3 shows the knitted component 100 following the heating process where a sample window region 113 still includes some residual amounts of melted portions 112 of the first yarn 110. FIG. 4 shows the knitted component 100 following the heating process, where a user stretches the knitted component 100 as described, to remove the residual amounts of melted portions 112 of the first yarn 110 from one or more window regions, including window region 113.

Figure 2C:
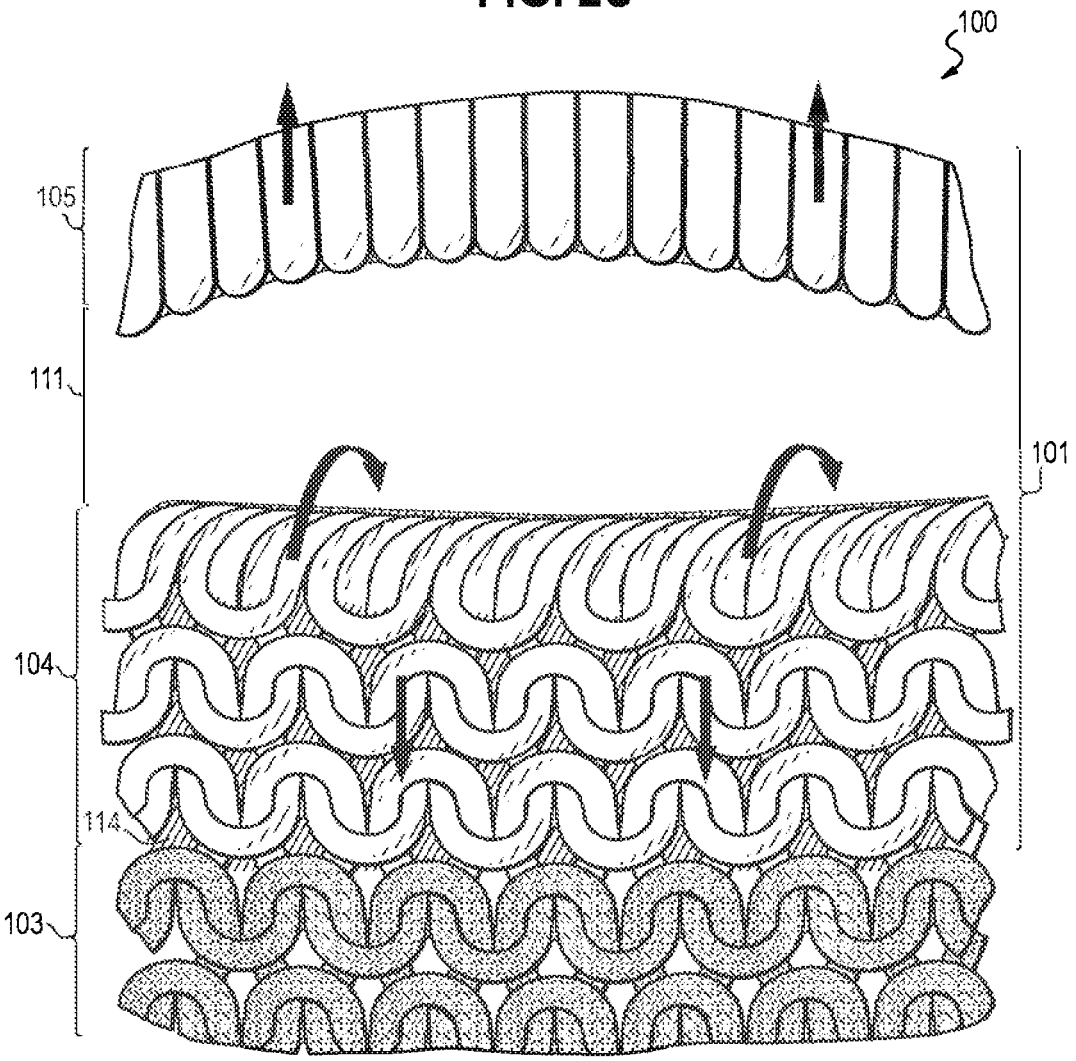
FIG. 2C shows a magnified view of the exemplary knitted component shown in FIG. 2A after a heating process and an activated curling property in accordance with certain embodiments of this disclosure.

When the first yarn 110 within the first window region 101 no longer connects respective edges of the upper edge portion 105 and lower edge region 104 following the heating process, the lower edge region 104 may be referred to as the curling region 104. In the curling region 104, the ends of the knitted loops 106 from the curling region 104 may be left as a "raw" edge following the release of the first yarn 110 from the first window 101, and thus left susceptible to fraying and/or unraveling. However, because the first yarn 110 is also included in the curling region 104, the heating process (and/or a separate heating process) may also melt the first yarn 110 to cover, fuse and/or otherwise bind to at least a part of the second yarn 120 in the curling region 104. These melted portions 114 of the first yarn 110 are shown in FIGS. 2B and 2C as at least partially fusing to portions of the remaining second yarn 120 in the curling region 104. In particular, FIG. 2B shows the melted portions 114 of the first yarn 110 as binding the ends of the knitted loops 106 in the curling region 104. By covering, fusing to and/or binding to the second yarn 120, the melted portions 114 of the first yarn 110 act to secure and "seal off" raw edges of the second yarn 120 on the edges of the curling region 104 to prevent unwanted fraying or unraveling.

For illustrative purposes, FIG. 2B does not show the curling region 104 having its natural curling tendencies allowing it to achieve a curled state, such as where it curls inwards and/or downwards. However, FIG. 2C shows a magnified view of the first window region 101 after a heating process is applied, and where the natural curling tendencies of the curling region 104 are uninhibited and thus show the curling region 104 in a curled state. In its curled state, the curling of the knitted component 100 within the curling region 104 acts to further secure the raw edges of the second yarn 120 following the heating process. The curling is achieved from the natural curling tendencies of the curling region 104 that are provided by the specific knit structure used in the curling region 104. In one example, a specific knit structure that has a tendency to curl is a single jersey knit type of knitting structure. It will be appreciated that one or more other knit structures or knitting techniques (e.g., knitting the single jersey knit structure from an elastomeric yarn and or utilizing a tighter knit structure and/or more densely knit structure) may be used to produce the type and extent of curl necessary to achieve the desired curling effect. It will be appreciated that the natural curling tendency of the single jersey knit structure in the curling region is inhibited (thus restricting curl) when at least a portion of the first and second edges 104 and 105 are still secured together by the first yarn (prior to a heating process). However, immediately after a heating process, the removal of the first yarn 110 from the window opening 111 allows the yarn within the curling region 104 to return to its natural state (e.g., at least partially curled) as the tendency to curl is no longer restricted and/or prevented by the first yarn 110 attaching the upper edge region 105 to the lower edge region 104. In other words, with the first yarn 110 removed by the heating process, the curling tendency provided by the specific knit structure in the curling region 104 may cause the curling region 104 to curl, as the first yarn 110 no longer prevents, inhibits or otherwise restricts the curling via securement of the curling region 104 to the upper edge portion 105.

Figure 5:
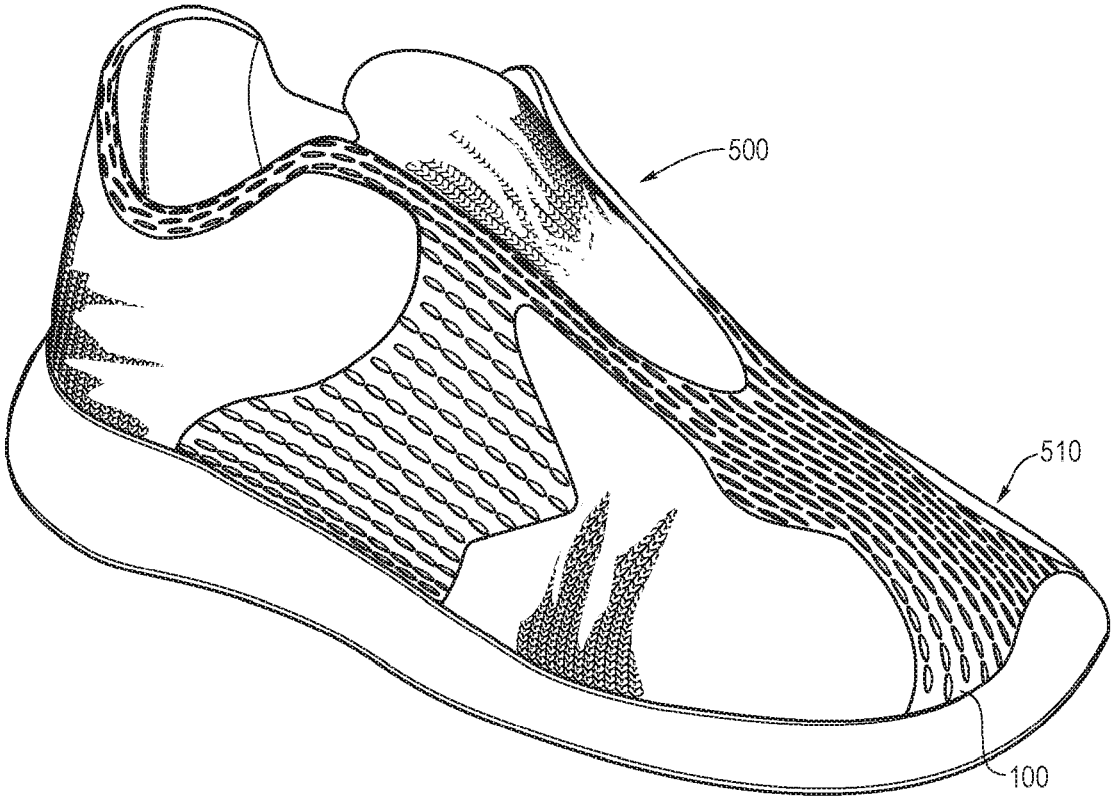
FIG. 5 shows an exemplary article of footwear incorporating at least portions of the exemplary knitted component shown in FIG. 4 in accordance with certain embodiments of this disclosure.

FIG. 5 shows an exemplary article of footwear 500 incorporating the knitted component 100 described herein. In the article of footwear 500, the knitted component 100 is used to form at least a portion of the upper 510, where having one or more openings is desired to form a particular structure and/or aesthetic appearance. While not shown, it is contemplated that such openings could provide openings for receiving a shoelace or other fastening element.

Figure 6:
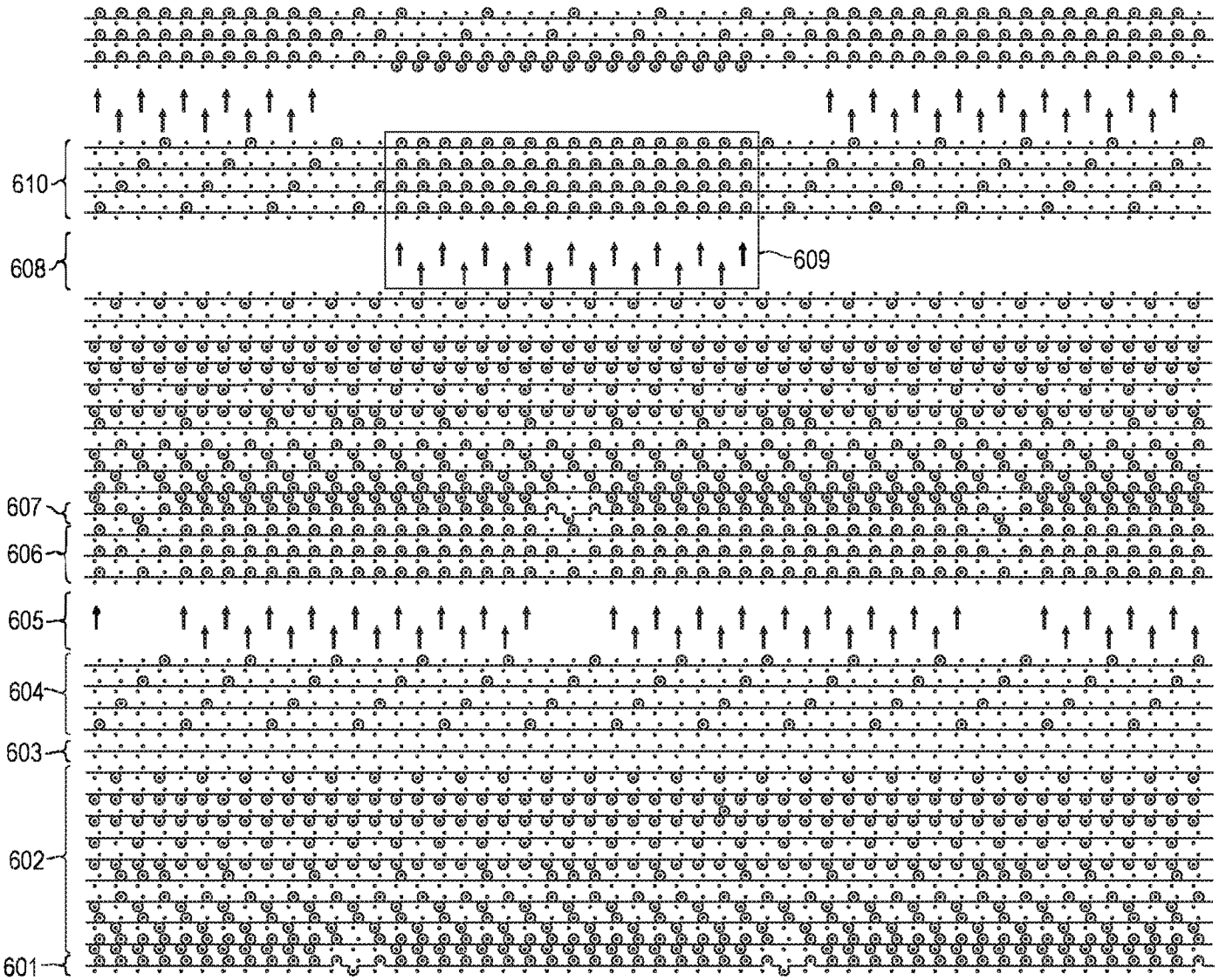
FIG. 6 shows an exemplary knit diagram for knitting at least a portion of a knitted component in accordance with certain embodiments of this disclosure.

FIG. 6 shows an exemplary knit diagram 600 for knitting at least a portion of the knitted component 100 on a flat knitting machine with two needle beds. While FIG. 6 represents one possible knitting sequence, it will be appreciated that other knitting sequences may be used, including the use of different yarns and/or different knitting techniques to form one or more window regions.

The knit diagram 600 includes a window course 601 using the first yarn 110. This window course 601 is comprised primarily of loops formed on a back needle bed, and with intermittent tuck stitches on the front and back needle beds of the knitting machine. The intermittent tuck stitches may be repeated at predetermined intervals (e.g., every 18 needles) to form uniform window sizes. The intervals of tuck stitches in the window course 601 may control a size of the windows filled with the first yarn 110, as well as control the first yarn 110 as a yarn carrier of the flat knitting machine moves to each window region. According to some embodiments where uniform window sizes are not desired, the predetermined intervals of tuck stitches in the window course 601 may include two or more interval lengths. According to some embodiments, the entire window course 601 may be comprised of knit stiches.

The knit diagram 600 further includes a set of design courses 602 using the second yarn 120, where the design courses 602 follow the window course 601. In the knit diagram 600, nine courses are shown to be included in the set of design courses 602. However, the design courses 602 may be a collection of one or more courses using the second yarn 120 to create a desired design having visual and/or textural effects (e.g., different colored designs or different textured designs). The knit structures used in the design courses 602 may be any combination of single and double knit jersey structures that utilize the front and back needle beds, respectively.

The knit diagram 600 further includes an inlay step 603 using an inlay yarn following the design courses 602 (and it will be appreciated that such an inlay step 603 may be performed prior to and/or during rather than only at the conclusion of forming the design courses 602). The inlay yarn may be the second yarn 120. According to other embodiments, the inlay yarn may be a yarn having a greater thickness compared to the second yarn 120 to achieve an increased thickness to the knitted component 100 where the inlay yarn is used. Furthermore, two or more steps of inlaying a yarn or other strand (including a monofilament strand) may be applied according to other embodiments.

The knit diagram 600 further includes a set of monofilament courses 604 using a monofilament strand following the inlay course 605. The monofilament strand may be a polyester-based, or other synthetic material-based, single strand. Although four courses of the monofilament strand are shown in the knit diagram 600, a different number of courses of the monofilament strand may be used according to other embodiments. The monofilament strands included at this step may be used elsewhere to provide window openings, as described above, to "fill-in" a window region for aesthetic purposes, and/or may be used to optimize the transition between the design courses 602 and downstream courses (e.g., such as those that form the curling region 104 described above).

The knit diagram 600 further includes a transfer step 605 following the monofilament courses 604. The transfer step 605 functions to transfer all the loops held on the front bed to the back bed. Although the transfer step 605 illustrated in the knit diagram 600 is for transferring the loops from the front bed to the back bed, a transfer step for transferring the loops from the back bed to the front bed may be applied according to other embodiments. Such a transfer step 605 allows for downstream knitting of a single jersey knit structure, such as that formed by the single jersey courses 606.

The knit diagram 600 further includes a set of single jersey courses 606 following the transfer step 605. As mentioned above, the preceding transfer step 605 sets up the subsequent set of single jersey courses 606, as the loops that were previously on both need beds are now all transferred to the back needle bed to achieve the single jersey knit structures in the set of single jersey courses 606. Here, because the transfer step 606 transferred all the loops to the back needle bed, the set of single jersey courses 606 will be knitting reverse single jersey knit structures. If the transfer step 606 had transferred all the loops to the front needle bed, the set of single jersey courses 606 would be knitting front jersey knit structures. As described herein, the single jersey knit structure has an inherent curling tendency. Therefore, the set of single jersey courses 606 correspond to the rows of the curling region 104. It also follows that the yarn used in the set of single jersey courses 606 is the plated yarn that combines the first yarn 110 and the second yarn 120.

The knit diagram 600 repeats with a second window course 607 using the first yarn 110 following the single jersey courses 606. As shown, the window course 607 may be offset relative to the window course 601. This second window course 607 is comprised primarily of knitting on a back needle bed, and with intermittent tuck stitches on the front and back needle beds of the knitting machine. The intermittent tuck stitches may be repeated at predetermined intervals (e.g., every 18 needles) to form uniform window sizes. The intervals of tuck stitches in the second window course 607 may control a size of the windows filled with the first yarn (e.g. where, prior to heating, the first edge (curling region 104) and second edge 105 are still releasably secured by the first yarn, which will later become a window opening after heating). Following the window course 607, the knit component may include an "edge-2" sequence comprising one or more courses configured to optimize a new edge (e.g., the new edge may be the beginning/end of the knitted component 100). The first course within the "edge-2" sequence may be referred to as a "cast-on row" where typically the knit structure in the "cast-on row" utilizes all needles. According to some embodiments where uniform window sizes are not desired, the predetermined intervals of tuck stitches in the second window course 607 may include two or more interval lengths. According to some embodiments, the entire second window course 601 may be comprised of knit stiches.

The subsequent courses in the knit diagram 600 may be implemented as shown. Of note, a second transfer step 608 is concentrated on transferring loops from the front needle bed to the back needle bed in a predefined region 609. Following the second transfer step 608, the knit diagram includes a second set of monofilament courses 610 using a monofilament strand. The second set of monofilament courses 610 is shown to include a concentration of stitches on the back needle bed within the same predefined region 609 where the second transfer step occurred. This results in a specialized window region that is filled with the monofilament strand, instead of the first yarn 110 as described for other windows.

All of the structures and methods disclosed and claimed herein can be made and executed without undue experimentation in light of the present disclosure. While this disclosure may be embodied in many different forms, there are described in detail herein specific aspects of the disclosure. The present disclosure is an exemplification of the principles of the disclosure and is not intended to limit the disclosure to the particular aspects illustrated. In addition, unless expressly stated to the contrary, use of the term "a" is intended to include "at least one" or "one or more." For example, "a yarn" is intended to include "at least one yarn" or "one or more yarns."

Any ranges given either in absolute terms or in approximate terms are intended to encompass both, and any definitions used herein are intended to be clarifying and not limiting. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and opening values) subsumed therein.

Furthermore, the disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the disclosure and without diminishing its intended advantages. It is therefore intended that such changes and modifications be covered by the appended claims.

What is claimed is:

1. A textile, comprising:

a first surface;

a window opening within the first surface having a first edge and a second edge that are separated to define the window opening therebetween;

a curling region on the first surface adjacent to the first edge, wherein the curling region comprises a first yarn comprising a thermoplastic material and a second yarn;

a transition region on the first surface adjacent to the second edge, wherein the transition region comprises the second yarn, and wherein the second yarn in the transition region is knit in a double jersey knit structure; and a region comprising an inlaid monofilament strand.

2. The textile of claim 1, wherein the window opening has a first longitudinal diameter, and wherein the textile further comprises a second window opening having a second longitudinal diameter.

3. The textile of claim 1, wherein the textile is flat knitted.

4. The textile of claim 1, wherein the first yarn and the second yarn curve inwards and/or downwards in the curling region.

5. The textile of claim 1, wherein the first yarn in the curling region is at least partially fused to the second yarn.

6. The textile of claim 5, wherein the first yarn in the curling region that is fused covers a raw edge knit loop of the second yarn.

7. The textile of claim 1, wherein the region is a design region, the design region comprising the first yarn and the inlaid monofilament strand.

8. The textile of claim 1, wherein the textile forms at least part of an article of footwear.

9. The textile of claim 1, wherein the textile forms at least part of an article of apparel.

10. A textile, comprising:

a first surface;

a window opening within the first surface having a first edge and a second edge that are separated to define the window opening therebetween, wherein a monofilament strand at least partially secures the first edge of the window opening to the second edge of the window opening;

a curling region positioned on the first surface adjacent to the first edge, wherein the curling region comprises a first yarn comprising a thermoplastic material and a second yarn; and a transition region positioned on the first surface adjacent to the second edge, wherein the transition region comprises the second yarn.

11. The textile of claim 10, wherein the first yarn has a first melting temperature that is greater than 55 degrees Celsius.

12. The textile of claim 11, wherein the second yarn has a second melting temperature that is greater than 170 degrees Celsius.

13. The textile of claim 10, wherein the second yarn in the transition region is knit in a double jersey knit structure.

14. The textile of claim 10, wherein the textile forms at least part of an article of footwear.

15. A textile, comprising:

a first surface;

a window opening within the first surface having a first edge and a second edge that are separated to define the window opening therebetween, wherein a monofilament at least partially secures the first edge of the window opening to the second edge of the window opening;

a curling region positioned on the first surface adjacent to the first edge, wherein the curling region comprises a first yarn comprising a thermoplastic material and a second yarn, and wherein the first yarn is at least partially fused to the second yarn in the curling region; and a transition region positioned on the first surface adjacent to the second edge, wherein the transition region comprises the second yarn.

16. The textile of claim 15, wherein the first yarn in the curling region that is at least partially fused covers a raw edge knit loop of the second yarn.

17. The textile of claim 15, wherein the second yarn in the transition region is knit in a double jersey knit structure.

18. The textile of claim 15, wherein the textile forms at least part of an article of footwear.

19. The textile of claim 15, further comprising a design region, the design region comprising the first yarn and a monofilament strand inlaid into the design region.

* * * * *